US010839724B2

(12) United States Patent
Torpy

(10) Patent No.: US 10,839,724 B2
(45) Date of Patent: Nov. 17, 2020

(54) FLAGPOLE SECURITY

(71) Applicant: Peter Brian Torpy, Butler (AU)

(72) Inventor: Peter Brian Torpy, Butler (AU)

(73) Assignee: Peter Brian Torpy, Butler (AU)

( * ) Notice: Subject to any disclaimer, the term of this patent is extended or adjusted under 35 U.S.C. 154(b) by 0 days.

(21) Appl. No.: 16/486,053

(22) PCT Filed: Feb. 13, 2018

(86) PCT No.: PCT/AU2018/050110
§ 371 (c)(1),
(2) Date: Aug. 14, 2019

(87) PCT Pub. No.: WO2018/148790
PCT Pub. Date: Aug. 23, 2018

(65) Prior Publication Data

US 2020/0058240 A1 Feb. 20, 2020

(30) Foreign Application Priority Data

Feb. 15, 2017 (AU) ..... 2017900500

(51) Int. Cl.
*G09F 17/00* (2006.01)
*E04H 12/32* (2006.01)
(Continued)

(52) U.S. Cl.
CPC ..... *G09F 17/00* (2013.01); *E04H 12/32* (2013.01); *E05B 67/383* (2013.01); *F21S 8/08* (2013.01);
(Continued)

(58) Field of Classification Search
CPC ..... G09F 17/00; G09F 17/0091; G09F 2017/0066; G09F 2017/0025;
(Continued)

(56) References Cited

U.S. PATENT DOCUMENTS 1,855,824 A * 4/1932 Crichton ..... E04H 12/32 116/173
3,927,315 A * 12/1975 Werry ..... F21V 21/02 362/382
(Continued)

FOREIGN PATENT DOCUMENTS

DE 102004032153 B3 * 2/2006 ..... G09F 17/00
DE 202014004246 U1 6/2014
GB 1329073 A 9/1973

OTHER PUBLICATIONS

Emmeran, Flag pole and hoist has drive mechanism with brake element displaceable between console bracket and cover plate associated with drive roller and operable through bolt movable in pole groove between actuating and block positions, Feb. 2, 2016, DE102004032153B3, English (Year: 2006).*
(Continued)

*Primary Examiner* — Bryon T Gyllstrom
*Assistant Examiner* — James M Endo
(74) *Attorney, Agent, or Firm* — Winstead PC

(57) ABSTRACT

Provided is an outrigger flagpole assembly (10) which comprises a wall-mountable bracket (12), a flagstaff (14) for displaying a flag (20), and a security device or locking formation (14.2) for releasably locking a flag (20) to be displayed to the flagstaff (14) or to the wall-mountable bracket (12). In general, the flagstaff (14) is attached at one end (14.1) thereof to the wall-mountable bracket (12), with a free end (14.2) of the flagstaff (14) extending away from a wall (18) to which the bracket (12) is mounted.

15 Claims, 11 Drawing Sheets

(51) Int. Cl.

| | |
|---|---|
| ***E05B 67/38*** | (2006.01) |
| ***F21S 8/08*** | (2006.01) |
| ***F21S 9/03*** | (2006.01) |
| ***F21V 15/01*** | (2006.01) |
| ***F21V 21/116*** | (2006.01) |
| ***F21V 23/02*** | (2006.01) |
| ***F21V 23/04*** | (2006.01) |
| ***F21V 23/06*** | (2006.01) |
| ***F21Y 103/10*** | (2016.01) |
| ***F21Y 115/10*** | (2016.01) |

(52) U.S. Cl.
CPC ..... *F21S 9/035* (2013.01); *F21V 15/01* (2013.01); *F21V 21/116* (2013.01); *F21V 23/02* (2013.01); *F21V 23/0464* (2013.01); *F21V 23/06* (2013.01); *F21Y 2103/10* (2016.08); *F21Y 2115/10* (2016.08)

(58) Field of Classification Search
CPC .. G09F 2017/005; F21V 21/116; F21V 21/36; F21V 21/26; F21V 21/34; F21V 21/0885; F21V 21/08; F21V 21/30; E04H 12/32; F21W 2131/101; F21W 2131/103; F21W 2131/109; Y02B 20/72; F21S 8/088; F21S 8/086; F21S 8/036
USPC ..... 362/431, 427, 559
See application file for complete search history.

(56) References Cited

U.S. PATENT DOCUMENTS 4,641,448 A * 2/1987 Cobb ..... G09F 7/18 40/607.02
4,920,910 A * 5/1990 Lin ..... G09F 17/00 116/173
5,330,084 A 7/1994 Peters
5,454,202 A * 10/1995 van der Weijden .... E04H 12/32 116/173
5,697,321 A 12/1997 Dobbins
5,988,100 A 11/1999 Schmitt
7,228,814 B1 6/2007 Williams, Sr.
7,685,754 B1 3/2010 Torres
7,931,385 B1 * 4/2011 Smith ..... F21S 9/03 362/145
8,215,807 B1 * 7/2012 Brunesti ..... G09F 17/00 362/431
2003/0024144 A1 * 2/2003 Jen ..... G09F 17/00 40/601
2005/0108909 A1 5/2005 Andersen
2006/0050528 A1 * 3/2006 Lyons ..... G09F 13/02 362/559
2006/0109651 A1 * 5/2006 Cocciardi ..... F21V 21/088 362/253
2006/0277823 A1 * 12/2006 Barnett ..... F21V 21/088 47/33
2009/0244881 A1 * 10/2009 Butler ..... F21V 21/116 362/20
2011/0122634 A1 * 5/2011 Liu ..... F21V 21/116 362/427
2012/0113625 A1 * 5/2012 Werner ..... F21S 9/037 362/183
2014/0075797 A1 * 3/2014 Urbina ..... G09F 17/00 40/607.01
2014/0373771 A1 * 12/2014 Woollett ..... G09F 17/00 116/173
2015/0211720 A1 * 7/2015 Toner ..... G09F 13/02 362/183
2016/0327233 A1 * 11/2016 Wei ..... F21S 9/037

OTHER PUBLICATIONS

International Search Report; prepared for application No. PCT/AU2018/050110; authorized officer Alexander Killeen; dated Mar. 22, 2018; 3 pages.

* cited by examiner

FLAGPOLE SECURITY

TECHNICAL FIELD

This invention relates to flagpole security. More specifically, this invention relates to a security system for flagpoles, a flagpole security kit, a flag for an outrigger flagpole assembly or kit, as well as a method for securing flags to flagpoles.

BACKGROUND ART

The following discussion of the background art is intended to facilitate an understanding of the present invention only. The discussion is not an acknowledgement or admission that any of the material referred to is or was part of the common general knowledge as at the priority date of the application.

A common type of flagpole known to the Applicant is the so-called outrigger flagpole. This type of flagpole is typically attached, cantilever-style, to the outside wall of a house or other form of building.

The flagpole is used to display flags and other insignia. However, a problem with these systems is that flag or insignia theft may occur, given the relatively low height at which these systems are displayed.

The present invention was conceived with this shortcoming in mind.

SUMMARY OF THE INVENTION

According to a first aspect of the invention there is provided an outrigger flagpole assembly comprising:

a wall-mountable bracket;

a flagstaff for displaying a flag, the flagstaff attachable in cantilever fashion at one end thereof to the wall-mountable bracket; and a security formation for releasably locking a flag to be displayed to the flagstaff or to the wall-mountable bracket.

As used herein, the term "flag" may refer to any piece of fabric of distinctive design that is used as a symbol, as a signalling device, or as a decoration. As used herein, the general parts of a flag are: canton (the upper inner section of the flag); field or ground (the entire flag except the canton and the field and hoist ends); fly end (the furthest edge from the hoist end); and hoist end (the edge used to attach the flag to the hoist).

By "flagstaff" is meant any pole, flagpole, flagmast, stanchion, or staff that can be used to support, hoist, and/or deploy a flag.

The wall-mountable bracket may include one or more connection points for connecting the flagstaff to the bracket.

A first connection point may be proximal a wall to which the bracket is to be mounted. A second connection point may be distal from the wall to which the bracket is to be mounted.

The first connection point may be in the form of an aperture for receiving a pivot or pin that allows the flagstaff to be pivoted relative to the wall, thereby to allow for an angle of the flagstaff to be adjusted to a desired angle relative to the wall.

The pivot or pin may include at least one security formation that may be used to securely and releasably fasten the pin to the wall-mounted bracket, thereby to prevent unauthorised removal of the flagstaff from the wall-mounted bracket.

The flagstaff may have a first end for engaging with the wall-mounted bracket and a second, free, end for engaging with the end of the flag distal from the wall.

The flagstaff may, in one embodiment of the invention, have a track or channel disposed within, and extending at least partially along the length of, the flagstaff. In another embodiment, the flagstaff may have a track or channel disposed upon, and extending at least partially along, an outer surface of the flagstaff, typically an operative, lower surface of the flagstaff.

The track may serve to receive and hold the flag when hoisted.

The flag may be attached to the track using an elongate track-engaging member. The track-engaging member may engage with the track or channel associated with the flagstaff to attach the flag to the flagstaff.

As such, in the case of an internal track within the flagstaff, the track-engaging member may be dimensioned to be receivable within the track.

In the case of an external track disposed upon an outer surface of the flagstaff, the track-engaging member may be dimensioned to be closely associated with, and mountable to, the track.

The track-engaging member may, in one embodiment, be a rigid, or semi-rigid, elongate member, which is attached to the hoist end of the flag.

In one embodiment of the invention, the track-engaging member may be in the form of an elongate, rigid pin.

In another embodiment of the invention, the track-engaging member may be any elongate member that provides a slight interference fit internal to the track associated with the flagstaff.

In another embodiment, the track-engaging member may cooperate with the track along a longitudinal axis thereof, external to the flagstaff.

The flagpole assembly of the invention may have a pulley associated therewith to aid the hoisting, retraction or deployment of the flag. The pulley may assist with the sliding insertion or removal of the track-engaging member associated with the flag.

As such, the flag may be mounted to the flagstaff by inserting one end of the track pin into the track, over which the flag may be slid once the flagstaff has been attached to the wall, and the flagstaff has been adjusted to a desired flagstaff angle.

Adjustment of the flagstaff angle may be accomplished by varying the arc defined between the flagstaff and the wall to which the flagstaff is mounted via the wall-mountable bracket. As such, the wall-mountable bracket may have adjustment means for adjusting the angle of the flagstaff. This may be in the form of toothed, ratcheted, infinitely adjustable friction plates, or by having pre-formed holes in the wall mountable brackets, separate from the mounting pins, through which a retaining pin or lock may be inserted to lock the flagstaff into position, as desired.

As such, the second connection point may be in the form of co-axial apertures that may be used to lock the flagstaff in place once a desired angle has been selected. The flagstaff may be locked in place to the wall-mounted bracket using a releasable detent. The detent may be in the form of a pin that passes through the second connection point, i.e. through the co-axial apertures.

The detent may include at least one security formation that may be used to securely, releasably fasten the detent to the wall-mounted bracket.

In one embodiment, the flag track-engaging member may have a securing or locking formation associated therewith for securing or locking the flag to the flagstaff or track. As such, the track or flagstaff may have a complementary securing formation associated therewith to which the flag and/or track-engaging member may be secured. Securing of the two securing formations to one another may be accomplished by locking them in place using a lock or other form of user-removable fastening or locking mechanism, or another form of tamper-proof fastening or locking system.

In one embodiment, the flagstaff securing formation may be provided at, or towards, an end of the flagstaff, proximal the wall-mountable bracket. In another embodiment, the flagstaff securing formation may be provided at, or towards, the second end of the flagstaff, i.e. distal from the wall-mountable bracket. In a further embodiment, the securing mechanism may be provided more centrally disposed upon the flagstaff, typically a flag-width distance away from the free end of the flagstaff.

Accordingly, for a particular application, the track-engaging member may be shaped and dimensioned to be capable of engaging with, and being locked or secured to, the corresponding one or more locking formations on the flagstaff. As such, the track-engaging member (or flag) may include at least one security formation that may be used to securely, releasably lock a flag to be displayed to the flagstaff, thereby to prevent unauthorised removal of the flag.

Advantageously, the flagstaff may be sectioned so that the flagstaff may be transported in compact, sectioned form to a desired area where it is to be deployed at full length. As such, the flagstaff may be provided with internally or externally co-operating engaging means for allowing the disassembly or assembly of the flagstaff. The locking or securing formations provided on the flagstaff may conveniently also be used to further secure or lock the flagstaff sections in place once constructed.

The bracket may be affixed to the wall by fasteners, typically in the form of screws, plugs, or rawl bolts or the like. Advantageously, the bracket may have one or more shielded apertures for receiving the fasteners, the shielded apertures being positioned such that, in use, they are shielded by the proximal end of the flagstaff, thereby decreasing the possibility that the flagpole assembly may be removed from the wall.

In one embodiment of the invention, an elongated locking formation (or "blank") is provided which is slotted or shunted into a complementarily-shaped channel or slot, such that the locking formation abuts (or nearly abuts) a proximal end of the flag pin or guide. Additionally, the distal end of the channel is blind. In this way, the distal end of the flag pin or guide abuts (or nearly abuts) the blind end of the channel on one end thereof, while being locked in place by the blank at the other end thereof. When the flagstaff is locked into position, the blank is held securely in place within the bracket, while also preventing unauthorised removal of the flag pin.

In an embodiment of the invention, the flagpole assembly includes an illuminator configured to operatively illuminate a flag locked to the flagstaff.

In an embodiment, the illuminator comprises a housing shaped and configured for operative fitment about at least a portion of the flagstaff in order the illuminate the flag, in use.

In an embodiment, the housing of the illuminator comprises a U-shaped channel dimensioned to operatively receive a portion of the flagstaff therein.

Typically, the illuminator comprises a plurality of light emitting diodes (LEDs). In an embodiment, the LEDS are arranged along a length of the housing. In another embodiment, the LEDs are incorporated into the flagstaff and/or the bracket.

In an embodiment, the illuminator includes a solar cell, an electrochemical cell and an ambient light sensor and/or a timer configured to activate the LEDs which are energised via the electrochemical cell, which is further configured to be charged by the solar cell.

In an embodiment, the illuminator includes an electrical connector for operative connection to an existing power grid for energising the LEDs, in use.

According to another aspect of the invention, there if provided a kit for an outrigger flagpole assembly, the kit comprising:

a wall-mountable bracket;

a flagstaff for displaying a flag, the flagstaff attachable in cantilever fashion at one end thereof to the wall-mountable bracket; and a security formation associated with the flagstaff for releasably locking a flag to be displayed to the flagstaff or to the wall-mountable bracket.

According to a still further aspect of the invention, there is provided a method of displaying a flag on an outrigger flagpole assembly, the method including the steps of providing the outrigger flagpole assembly or kit of the invention, selecting a desired flag to be raised, deploying the flag on the flagpole, and locking the flag in place using one or more of the security formations of the outrigger flagpole assembly.

A still further aspect of the invention provides a flag for an outrigger flagpole assembly or kit of the invention, the flag including a track-engaging member shaped and dimensioned to be closely associated with a track of a flagstaff of the assembly or kit of the invention, the track-engaging member including a securing formation for securing the flag and/or track-engaging member to the flagstaff of the flagpole assembly or kit.

BRIEF DESCRIPTION OF THE DRAWINGS

The description will be made with reference to the accompanying drawings in which.

DESCRIPTION OF EMBODIMENTS

Figure 1:
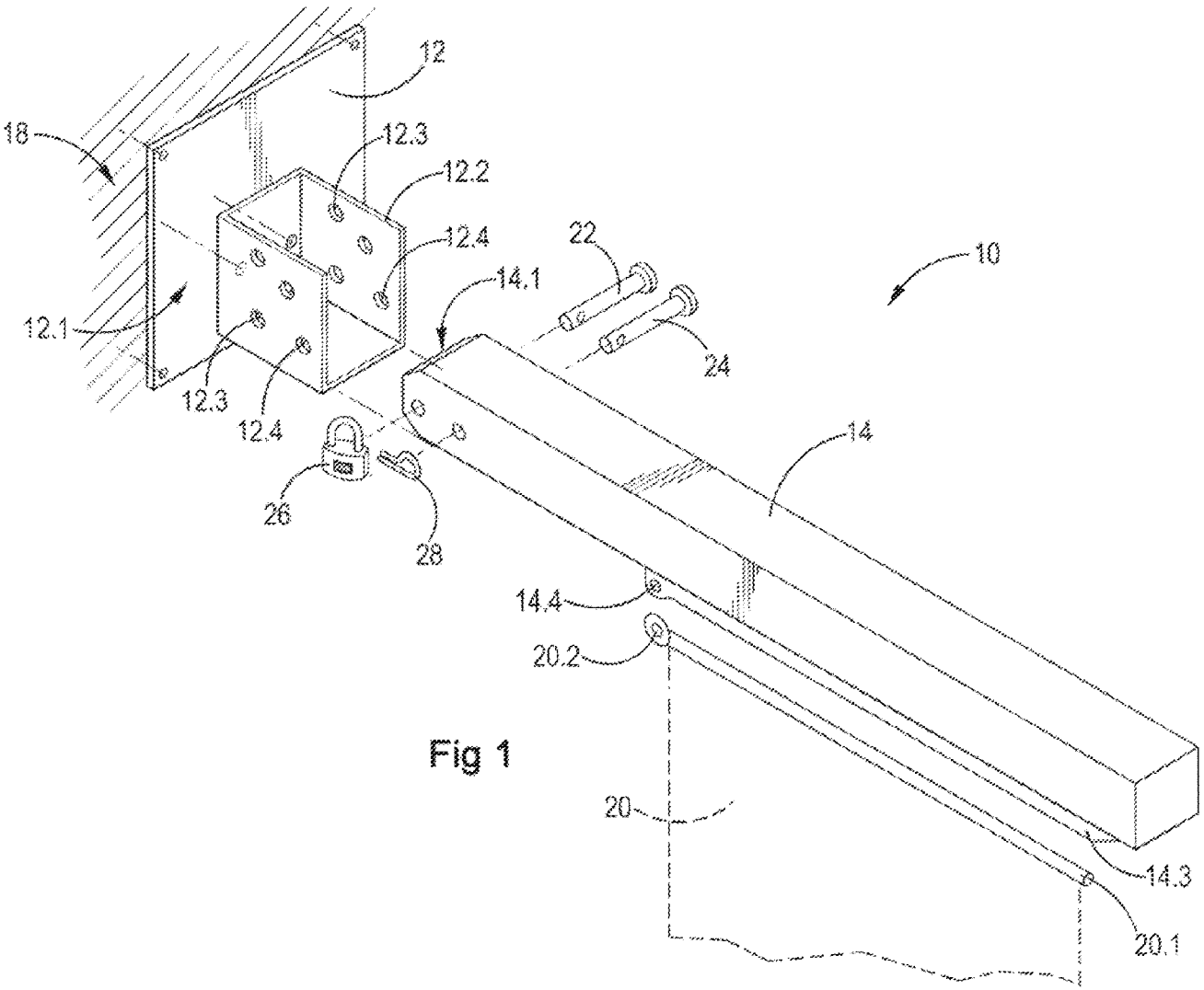
FIG. 1 shows a three-dimensional exploded view of a flagpole assembly in accordance with one embodiment of the invention.
Figure 2:
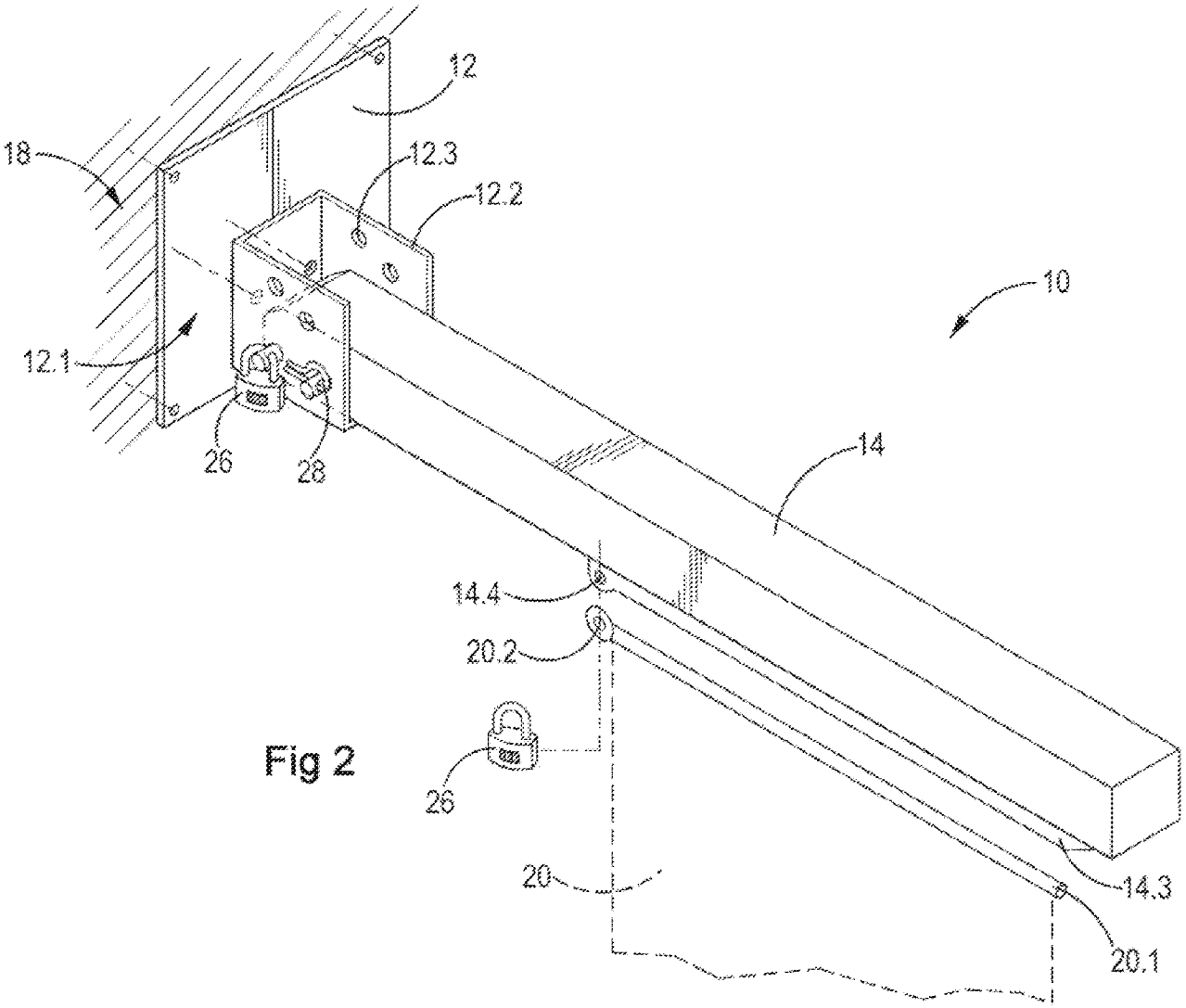
FIG. 2 shows a three-dimensional view of the flagpole assembly of FIG. 1, when mounted to a wall.
Figure 3A:
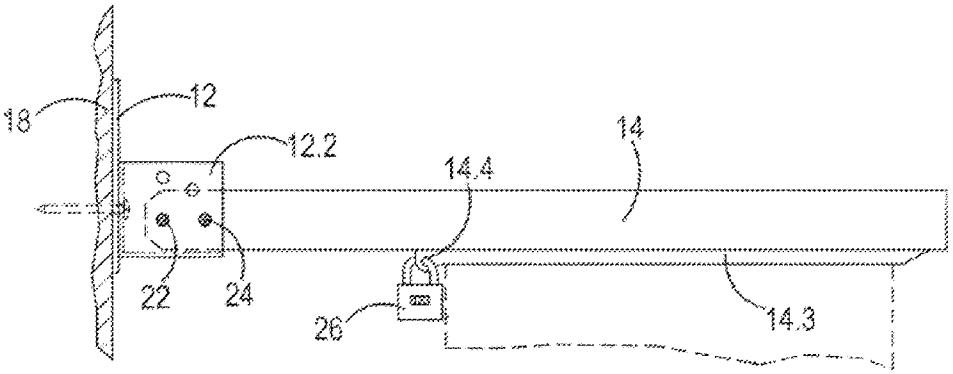
FIGS. 3A, 3B, and 3C show a flagpole assembly in accordance with one aspect of the invention in which the angle of the flagstaff has been adjusted relative to the wall to which the flagstaff assembly has been mounted.
Figure 3B:
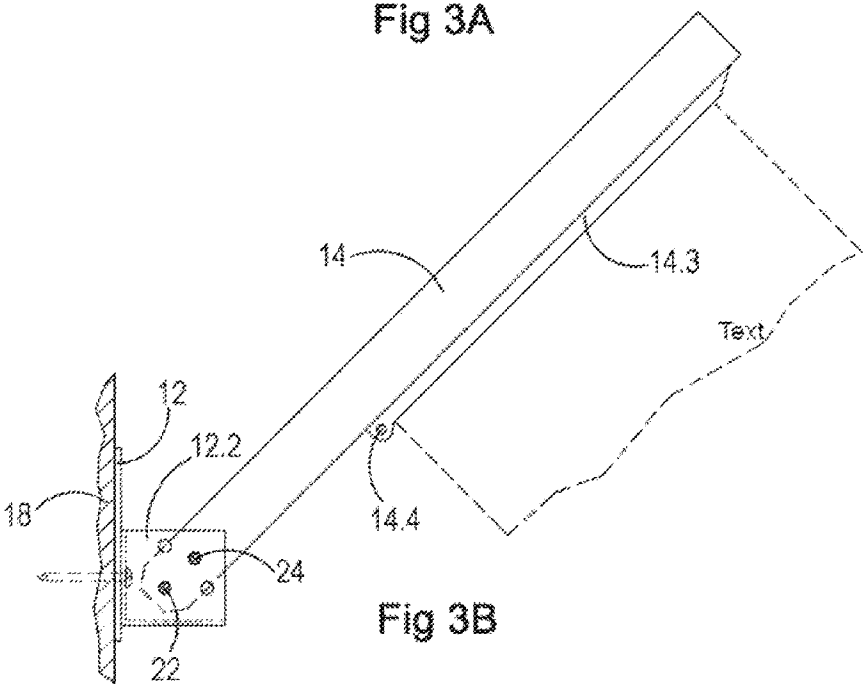
Figure 3C:
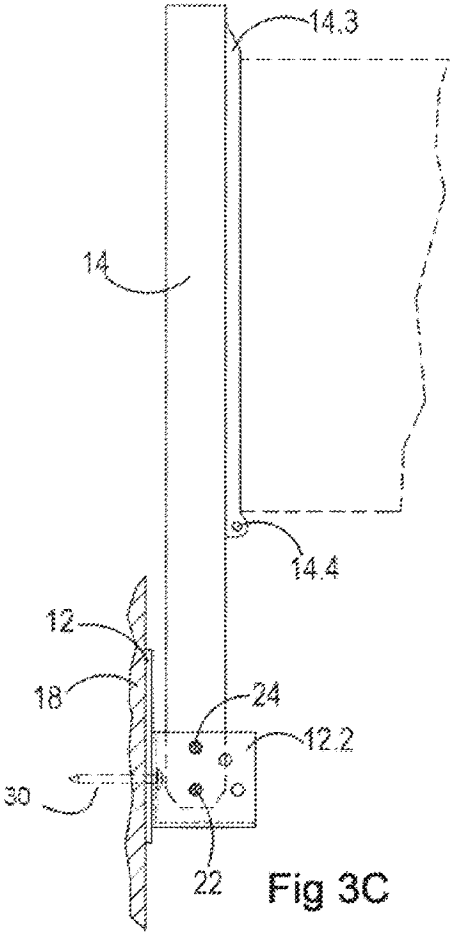

Further features of the present invention are more fully described in the following description of several non-limiting embodiments thereof. This description is included solely for the purposes of exemplifying the present invention to the skilled addressee. It should not be understood as a restriction on the broad summary, disclosure or description of the invention as set out above. In the figures, incorporated to illustrate features of the example embodiment or embodiments, like reference numerals are used to identify like parts throughout.

With reference now to FIG. 1, reference numeral 10 is used throughout this specification to indicate an outrigger flagpole assembly in accordance with one aspect of the invention.

In the embodiment shown in FIG. 1, an outrigger flagpole assembly 10 comprises a wall-mountable bracket 12, a flagstaff 14 for displaying a flag 20. In general, the flagstaff 14 is attached at one end 14.1 thereof to the wall-mountable bracket 12. A free end 14.2 of the flagstaff 14 extends away from a wall 18 to which the bracket 12 is mounted.

The flagstaff 14 includes a security device or locking formation 14.2 for releasably locking a flag 20 (shown in dotted lines for sake of clarity) to be displayed to the flagstaff 14 or to the wall-mountable bracket 12.

The wall-mountable bracket includes a base plate 12.1 and a cradle 12.2. The cradle 12.2 includes connection points 12.3 for connecting the flagstaff 14 to the bracket 12, and further apertures (or connection points) 12.4 slightly spaced from the connection points 12.3 and base plate 12.1.

The first connection points 12.2 (also referred to herein as pivot holes) are used to connect the flagstaff 14 to the base 12 using a pivot pin 22. It is conceivable that any type of pivot arrangement may be used to pivotally mount the flagstaff 14 to the base 12. The pivot holes 12.3 and pivot pin 22 arrangement allows the flagstaff to be pivoted relative to the wall, thereby to allow for the angle of the flagstaff to be adjusted to a desired angle relative to the wall 18. This may also be accomplished in another embodiment by using friction plates or any other suitable arrangement for varying the angle between the flagstaff 14 and the wall 18.

The pivot or pin 22 is locked in place through aperture 12.3 with a padlock 26 (key or coded), or other locking means. The flagstaff 14 is angled to a desired angle and then locked in place using pin 24 through aperture 12.4 using clip 28. Instead of a clip, a padlock may be used. This is done to prevent unauthorised removal of the flagstaff 14 from the wall-mounted bracket 12.

The flagstaff 14, in one embodiment of the invention (not shown), has a track or channel disposed within, and extending at least partially along the length of, the flagstaff. The embodiment shown in FIGS. 1 to 3C show a track 14.3 attached to and extending at least partially along, an outer surface of the flagstaff 14. The track 14.3 serves to receive and hold the flag 20, by way of track engaging member (or guide) 20.1 to which the flag 20 is securely sewn, glued, or otherwise attached.

In the case of an internal track, i.e. a track recessed within the flagstaff 14 (not shown), the track-engaging member 20.1 is dimensioned to be receivable within the track 14.3.

The track-engaging member 20.1 is typically a rigid or semi-rigid, elongate member or pin, which is dimensioned to be closely associated with the track 14.3.

In another embodiment of the invention wherein use is made of a channel or track (best illustrated in FIG. 5) at an operatively underside the flagstaff 14, the track-engaging member 20.1 is an elongate pin that provides a slight interference fit internal to the track associated with the flagstaff 14.

As such, the flag 20 may be mounted to the flagstaff 14 by inserting one end of the track pin (i.e. the track-engaging member) 20.1 into the track 14.3. The flag 20 is first slid over the track pin 20.1 which is then inserted into or locked to the flagstaff 14.

Returning to FIG. 1, the second connection points 12.4, are in the form of apertures that can be used to lock the flagstaff 14 in place once a desired angle has been selected. In the example shown, there are two apertures 12.4 distal from the wall 18, allowing the flagstaff 14 to be mounted perpendicular to the wall 18, or at a 45-degree angle relative to the wall. The flagstaff 14 is locked in place to the wall-mounted bracket 12 using a releasable, yet lockable, detent in the form of a pin 28 which may be secured with either another lock (not shown) or a split pin or hair pin 28.

Figure 4:
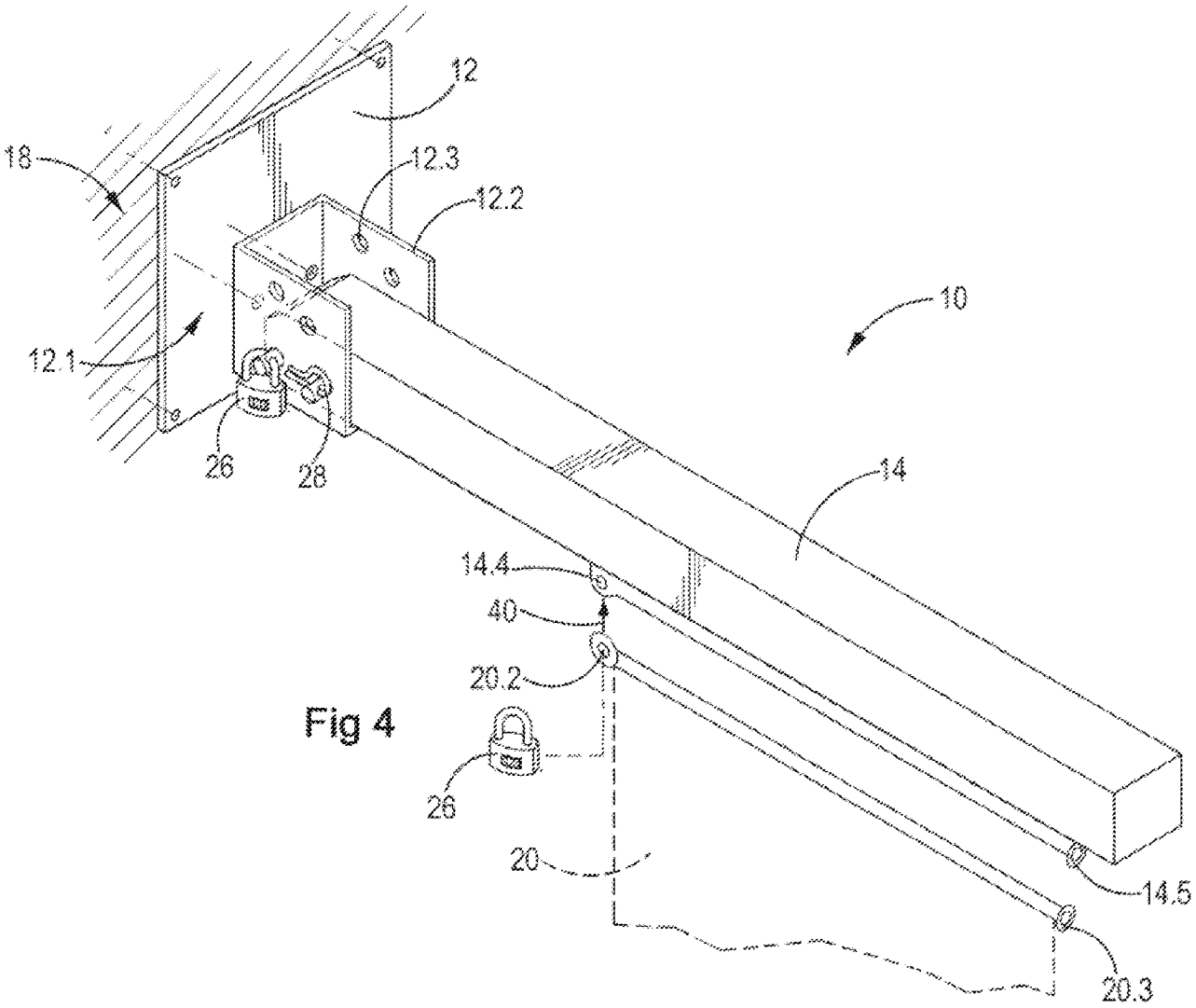
FIG. 4 shows a three-dimensional view of another embodiment of the flagpole assembly of the invention, showing the flagstaff locked in place and having additional securing formations.

In one embodiment, the flag track-engaging member (i.e. pin) 20.1 has a securable locking formation 20.2 associated therewith for securing or locking the flag 20 to the flagstaff 14 itself or to the track 14.3. In another embodiment, shown in FIGS. 1 to 4, the track 14.3 or flagstaff 14 itself is provided with a complementary securing formation 14.4 associated therewith to which the flag 20 and/or track-engaging member 20.1 is locked or secured. As such, securing of the two securing formations to one another may be accomplished by locking them in place using a lock 26 or other form of user-removable fastening or locking mechanism, or another form of tamper-proof fastening or locking system. The flagstaff 14, in the embodiment shown in FIG. 4, is provided with a further locking formation 20.3 in addition, or alternatively, to locking formation 20.2, which engages with a distal locking formation 14.5 and is also secured with a lock (not shown).

In the embodiments shown in FIGS. 1 to 4, the track-engaging member 20.1 is shaped and dimensioned to be capable of engaging with, and being locked or secured to, the corresponding one or more locking formations 20.2, 20.3 provided on the flagstaff 14.

Figure 5:
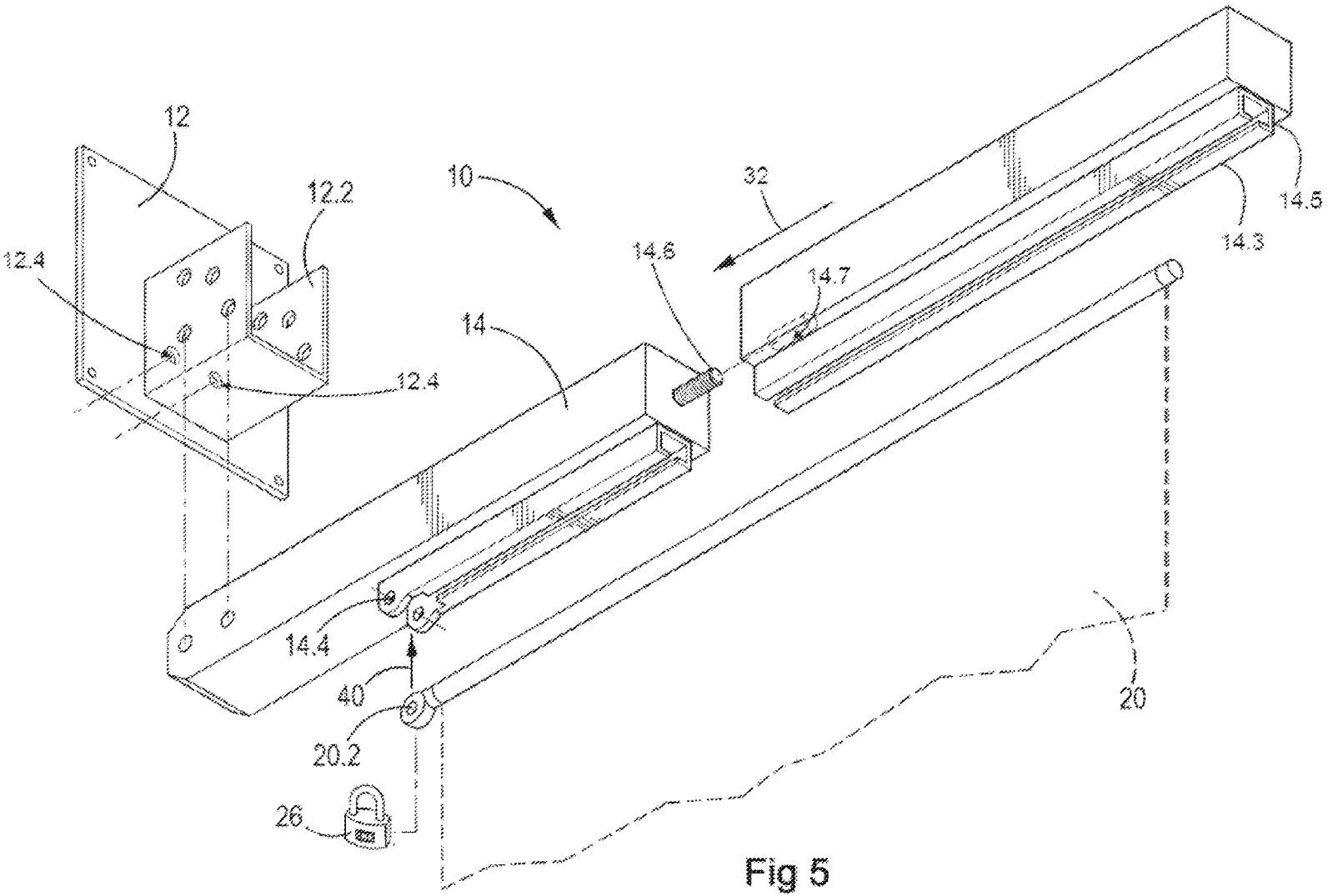
FIG. 5 shows a three-dimensional view of a flagpole assembly in accordance with another embodiment of the invention, where the flagstaff has a track disposed on an operatively lower surface of the flagstaff for receiving the flag and associated track-engaging member.

In the embodiment shown in FIG. 5, the flagstaff 14 is sectioned so that the flagstaff 14 can be transported in sectioned form to a desired area where it is to be deployed. The flagstaff is provided with internal engaging means in the form of a threaded rod 14.6 receivable within complementarily threaded aperture 14.7, thereby allowing the disassembly or assembly of the flagstaff 14. In another embodiment (not shown), the two sections of the flagstaff 14 are locked together using external over-centre clips disposed laterally on opposed outer surfaces of the flagstaff 14. It bears mentioning that the locking or securing formations 14.4 and 20.2 provided on the flagstaff 14 and flag pin (or guide) 20.1 can conveniently also be used to lock the flagstaff 14 sections in place once assembled.

Figure 6:
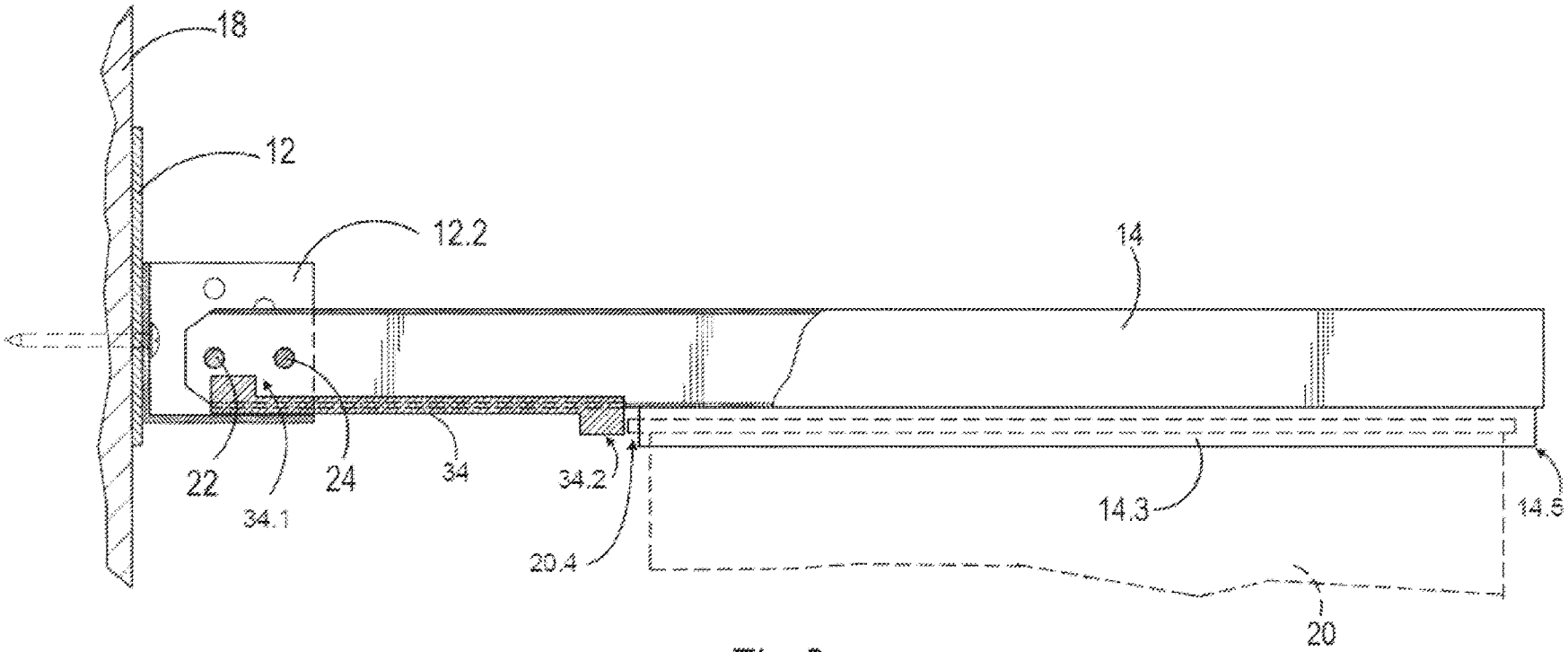
FIG. 6 is a cross-sectional side view of a yet further embodiment of the invention, in which a securing locking member is used to securely lock the flagstaff in place.
Figure 7:
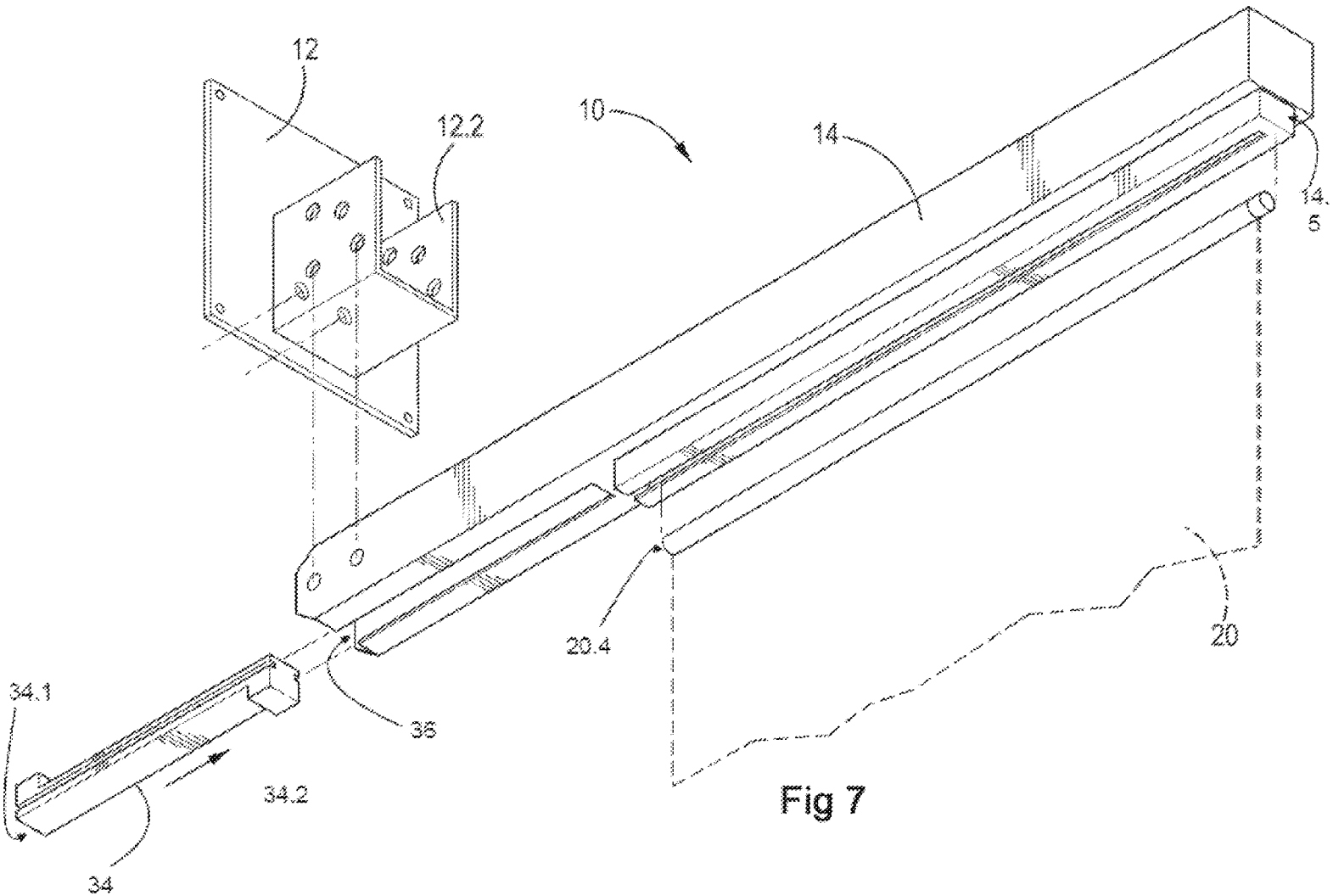
FIG. 7 shows a three-dimensional view of the embodiment illustrated in FIG. 6.

Another embodiment of the invention, shown in FIGS. 6 and 7, obviate the need for locking formations 20.2 and 20.3. In this embodiment, the distal end 14.5 of the channel 14.3 is in the form of a blind end. The flag pin 20.1 is inserted into the channel 14.3, following which a locking formation in the form of an elongated blank 34 is slotted into complementarily-shaped slot 36. When the flagstaff 14 is locked into position, the locking formation (blank) 34 is urged or kept in position toward, or against, a proximal end 20.4 of the flag pin (guide) 20.1. In this way, once the flagstaff 14 is locked into position, the blank 34 is held in place within the bracket 12, while also preventing unauthorised removal of the flag pin 20.1.

The flagpole assembly of the invention, in certain embodiments, has a pulley associated therewith to aid the retraction or deployment of the flag (not shown).

Referring now to FIGS. 8 to 11 of the accompanying drawings, there is shown an embodiment of the flagpole assembly 10 which includes an illuminator 38 which is configured to operatively illuminate the flag 20 locked to the flagstaff 14. In this embodiment, the illuminator 38 comprises a housing 40 which is shaped and configured for operative fitment about at least a portion of the flagstaff 14 in order the illuminate the flag 20, in use, as shown. The housing 40 of the illuminator 38 comprises a U-shaped channel 48 which is dimensioned to operatively receive or be slid over a portion of the flagstaff 14, as shown. The skilled addressee will appreciate that other configurations are possible and within the scope of the present invention.

Figures 8A, 8B:
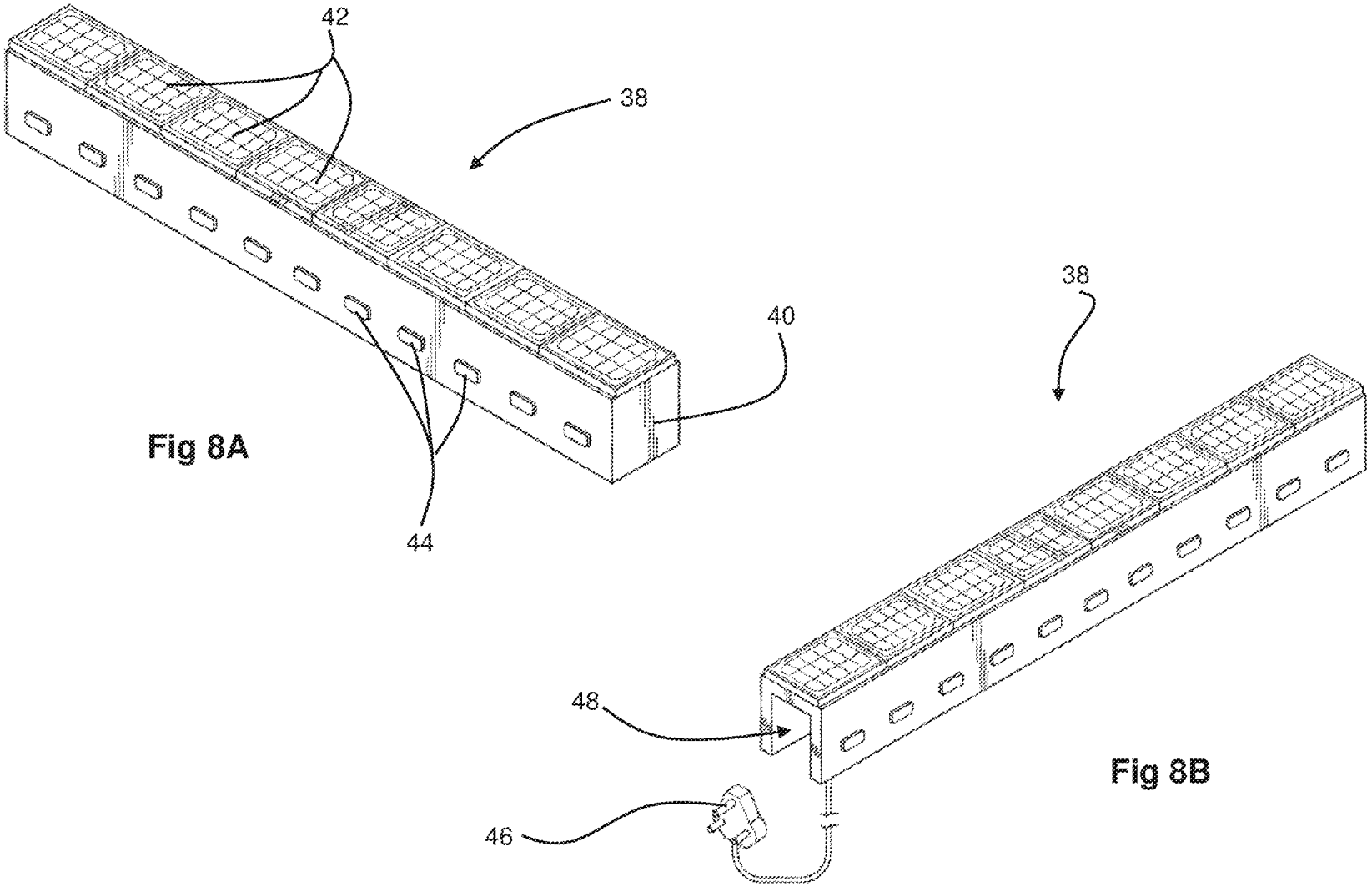
FIGS. 8A and 8B show diagrammatic perspective-view examples of an illuminator of the flagpole assembly which is usable to illuminate a flag secured to the assembly.
Figure 9:
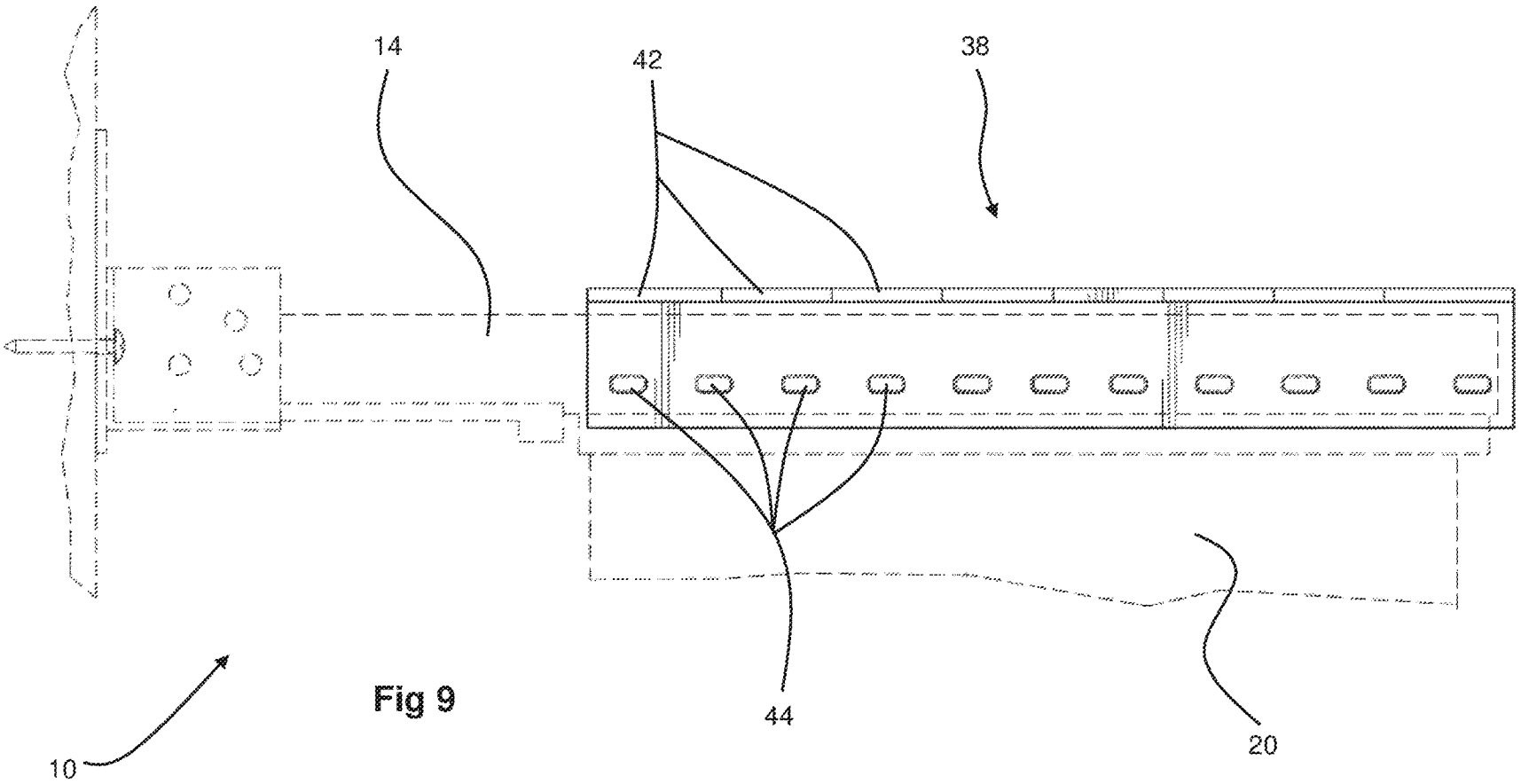
FIG. 9 shows a side-view of an illuminator of FIG. 8 fitted to the flagpole assembly.
Figure 10:
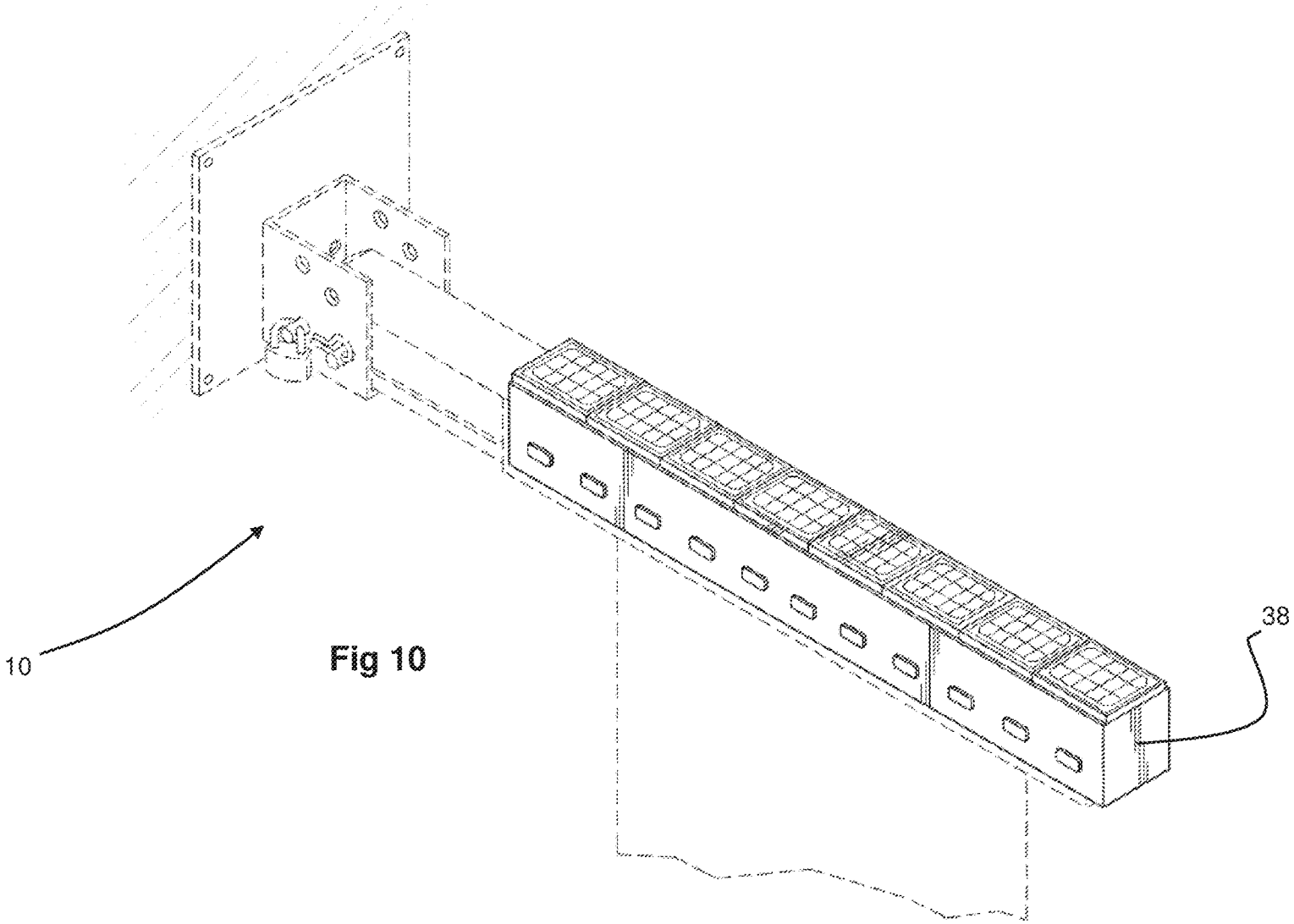
FIG. 10 shows a perspective-view representation of the illuminator of FIG. 9 when fitted to the flagpole assemble.
Figure 11:
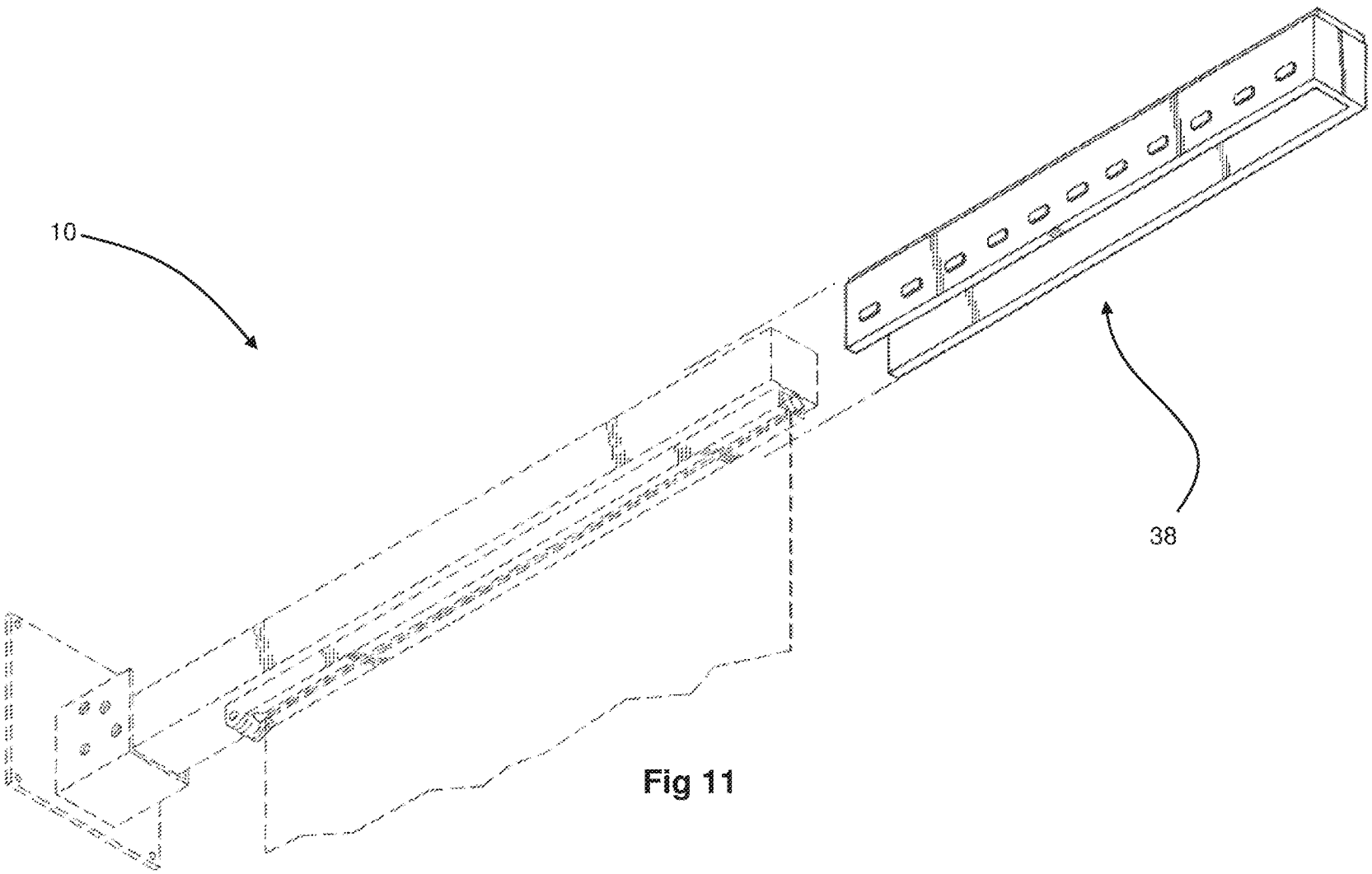
FIG. 11 shows perspective-view representation of an example of the illuminator being fitted to the flagpole assembly.

In the current example, the illuminator 38 comprises a plurality of light emitting diodes (LEDs) 44, which are arranged along a length of the housing 40. In other embodiments, the LEDs 44 may be incorporated directly into the flagstaff 14 and/or the bracket 12. The illuminator 38 also includes at least one solar cell 42, or a plurality of solar cells to form at least one solar panel, as is known in the art. The illuminator 38 further typically includes an electrochemical cell (not shown) and an ambient light sensor and/or a timer (not shown) which is configured to activate the LEDs 44 which are, in turn, energised via the electrochemical cell or battery. The battery is further configured to be charged by the solar cells 42, as is known in the art. In another embodiment, as shown in FIG. 8B, the illuminator 38 includes an electrical connector 44 for operative connection to an existing power grid for energising the LEDs 44, in use.

The invention extends further to a kit comprising a wall-mountable bracket 12, a flagstaff 14 for displaying a flag 20, with the flagstaff 14 attachable in cantilever fashion at one end thereof to the wall-mountable bracket 12, and a security formation 14.4 associated with the flagstaff 14 for releasably locking the flag 20 to be displayed to the flagstaff 14 or, in certain embodiments (not shown), directly to the wall-mountable bracket 12. As may be seen in FIGS. 4 and 5, the bracket also includes apertures 12.4 that, in use, are masked totally or partially by the flagstaff once locked in position, thereby making it difficult to remove screws or fasteners 30 (best seen in FIG. 3C) that may have been used to fix the bracket 12 to the wall 18 using these apertures 12.14.

According to a still further aspect of the invention, there is provided a method of displaying an outrigger flag on an outrigger flagpole assembly, the method including the steps of providing the outrigger flagpole assembly or kit of the invention, selecting a desired flag to be raised, deploying the flag on the flagpole, and locking the flag in place using one or more of the security formations of the outrigger flagpole assembly.

A still further aspect of the invention provides a flag for an outrigger flagpole assembly or kit of the invention, the flag including a track-engaging member shaped and dimensioned to be closely associated with a track of a flagstaff of the assembly or kit of the invention, the track-engaging member including a securing formation for securing the flag and/or track-engaging member to the flagstaff of the flagpole assembly or kit.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth. In the example embodiments, well-known processes, well-known device structures, and well-known technologies are not described in detail, as such will be readily understood by the skilled addressee.

The use of the terms "a", "an", "said", "the", and/or similar referents in the context of describing various embodiments (especially in the context of the claimed subject matter) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. As used herein, the term "and/or" includes any and all combinations of one or more of the associated listed items. No language in the specification should be construed as indicating any non-claimed subject matter as essential to the practice of the claimed subject matter.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

It is to be appreciated that reference to "one example" or "an example" of the invention, or similar exemplary language (e.g., "such as") herein, is not made in an exclusive sense. Various substantially and specifically practical and useful exemplary embodiments of the claimed subject matter are described herein, textually and/or graphically, for carrying out the claimed subject matter.

Accordingly, one example may exemplify certain aspects of the invention, whilst other aspects are exemplified in a different example. These examples are intended to assist the skilled person in performing the invention and are not intended to limit the overall scope of the invention in any way unless the context clearly indicates otherwise. Variations (e.g. modifications and/or enhancements) of one or more embodiments described herein might become apparent to those of ordinary skill in the art upon reading this application. The inventor(s) expects skilled artisans to employ such variations as appropriate, and the inventor(s)

intends for the claimed subject matter to be practiced other than as specifically described herein.

Any method steps, processes, and operations described herein are not to be construed as necessarily requiring their performance in the particular order discussed or illustrated, unless specifically identified as an order of performance. It is also to be understood that additional or alternative steps may be employed.

The invention claimed is:

1. An outrigger flagpole assembly comprising:

a wall-mountable bracket;

a flagstaff for displaying a flag, the flagstaff attachable in cantilever fashion at one end thereof to the wall-mountable bracket;

a security formation for releasably locking a flag to be displayed to the flagstaff or to the wall-mountable bracket, wherein the wall-mountable bracket includes one or more connection points for connecting the flagstaff to the bracket, a first connection point proximal a wall to which the bracket is to be mounted and a second connection point distal from the wall to which the bracket is to be mounted, wherein the first connection point is in the form of an aperture for receiving a pivot or pin that allows the flagstaff to be pivoted relative to the wall, thereby to allow for an angle of the flagstaff to be adjusted to a desired angle relative to the wall, the pivot or pin including at least one security formation that is useable to securely and releasably fasten the pin to the wall-mounted bracket, thereby to prevent unauthorised removal of the flagstaff from the wall-mounted bracket, the flagstaff having a track or channel disposed within or upon, and extending at least partially along the length or outer surface, respectively, of the flagstaff, said track serving to receive and hold the flag when hoisted, the flag operatively attachable to the track using an elongate track-engaging member which engages with the track or channel associated with the flagstaff to attach the flag to the flagstaff, said track-engaging member having a securing or locking formation associated therewith for securing or locking the flag to the flagstaff or track; and an illuminator configured to operatively illuminate a flag locked to the flagstaff, the illuminator comprising a housing shaped and configured for operative fitment about at least a portion of the flagstaff in order the illuminate the flag in use, wherein the housing is slidably received over at least a portion of the flagstaff and comprises a U-shaped channel having an open end and a closed end opposite the open end, and wherein the closed end abuts an end of the flagstaff opposite the wall-mountable bracket.

2. The flagpole assembly of claim 1, wherein the track-engaging member is dimensioned to be receivable within the track and comprises a rigid, or semi-rigid, elongate member which is attached to a hoist end of the flag.

3. The flagpole assembly of claim 1, which has a pulley associated therewith to aid the hoisting, retraction or deployment of the flag.

4. The flagpole assembly of claim 1, wherein the wall-mountable bracket includes adjustment means for adjusting the angle of the flagstaff.

5. The flagpole assembly of claim 1, wherein the second connection point is in the form of co-axial apertures that is useable to lock the flagstaff in place by means of a releasable detent once a desired angle has been selected, the detent including at least one security formation that is useable to securely, releasably fasten the detent to the wall-mounted bracket.

6. The flagpole assembly of claim 1, wherein the track-engaging member is shaped and dimensioned for engagement with, and being locked or secured to, the securing or locking formation of the track-engaging member.

7. The flagpole assembly of any of claim 1, wherein the track-engaging member includes the securing or locking formation that is useable to securely, releasably lock the flag to be displayed to the flagstaff, thereby to prevent unauthorised removal of the flag.

8. The flagpole assembly of any of claim 1, wherein the flagstaff is sectioned so that the flagstaff is transportable in compact, sectioned form to a desired area where it is to be deployed at full length, the flagstaff provided with internally or externally co-operating engaging means for allowing the disassembly or assembly of the flagstaff.

9. The flagpole assembly of claim 1, wherein the bracket is affixed to the wall by fasteners, and has one or more shielded apertures for receiving the fasteners, the shielded apertures being positioned such that, in use, they are shielded by the proximal end of the flagstaff, thereby decreasing the possibility that the flagpole assembly is removed from the wall.

10. The flagpole assembly of claim 1, wherein an elongated locking formation is provided which is slotted or shunted into a complementarily-shaped channel or slot in the flagstaff, said channel having a blind end, such that the elongated locking formation abuts a proximal end of the track-engaging member and the distal end of the track-engaging member abuts the blind end of the channel on one end thereof, while being locked in place by the elongated locking formation at the other end thereof, such that when the flagstaff is locked into position, the elongated locking formation is held securely in place within the bracket, while also preventing unauthorised removal of the tracking-engaging member.

11. The flagpole assembly of claim 1, wherein the illuminator comprises a plurality of light emitting diodes (LEDs).

12. The flagpole assembly of claim 11, wherein the LEDS are incorporated into the flagstaff and/or the bracket.

13. The flagpole assembly of claim 11, wherein the illuminator includes a solar cell, an electrochemical cell and an ambient light sensor and/or a timer configured to activate the LEDs which are energised via the electrochemical cell, which is further configured to be charged by the solar cell.

14. The flagpole assembly of claim 11, wherein the illuminator includes an electrical connector for operative connection to an existing power grid for energising the LEDs, in use.

15. A flag for the outrigger flagpole assembly of claim 1, the flag comprising the track-engaging member shaped and dimensioned to be closely associated with the track of the flagstaff of the outrigger flagpole assembly, the track-engaging member including a securing formation for securing the flag and/or track-engaging member to the flagstaff of the outrigger flagpole assembly.

* * * * *